US012648653B2

(12) United States Patent
Alqudah

(10) Patent No.: US 12,648,653 B2
(45) Date of Patent: Jun. 9, 2026

(54) FOLDABLE BED BOX SPRING

(71) Applicant: Mohammad Khaled Alqudah, Woodland Park, NJ (US)

(72) Inventor: Mohammad Khaled Alqudah, Woodland Park, NJ (US)

( * ) Notice: Subject to any disclaimer, the term of this patent is extended or adjusted under 35 U.S.C. 154(b) by 80 days.

(21) Appl. No.: 18/655,245

(22) Filed: May 4, 2024

(65) Prior Publication Data

US 2025/0338969 A1 Nov. 6, 2025

(51) Int. Cl.

| | |
|---|---|
| ***A47C 23/00*** | (2006.01) |
| ***A47C 19/02*** | (2006.01) |
| ***A47C 19/04*** | (2006.01) |
| ***A47C 19/12*** | (2006.01) |

(52) U.S. Cl.

CPC ..... *A47C 23/005* (2013.01); *A47C 19/025* (2013.01); *A47C 19/045* (2013.01); *A47C 19/122* (2013.01); *A47C 19/021* (2013.01); *A47C 19/04* (2013.01); *A47C 19/12* (2013.01); *A47C 23/00* (2013.01)

(58) Field of Classification Search

CPC ..... A47C 23/005; A47C 23/007; A47C 23/00; A47C 19/005; A47C 19/021; A47C 19/025; A47C 19/04; A47C 19/045; A47C 19/12; A47C 19/122

USPC ..... 5/717, 716, 400, 200.1, 201, 202

See application file for complete search history.

(56) References Cited

U.S. PATENT DOCUMENTS

| | | | | | |
|---|---|---|---|---|---|
| 97,522 | A * | 12/1869 | Kittle | A47C 27/05 | 5/722 |
| 3,142,848 | A * | 8/1964 | Blecker | A47C 19/124 | 5/174 |
| 4,128,907 | A * | 12/1978 | Gelbart | A47C 19/021 | 5/924 |
| 7,174,583 | B2 * | 2/2007 | Hofmann | A47C 19/025 | 5/200.1 |
| 7,296,310 | B2 * | 11/2007 | Kozlowski | A47C 19/045 | 5/236.1 |
| 7,376,988 | B2 * | 5/2008 | Wickstrom | A47C 23/005 | 5/174 |

(Continued)

FOREIGN PATENT DOCUMENTS

| | | | | |
|---|---|---|---|---|
| WO | WO-2007081476 A2 * | 7/2007 | | A47C 23/04 |
| WO | WO-2012024477 A1 * | 2/2012 | | A47C 23/005 |

(Continued)

*Primary Examiner* — Robert G Santos

(57) ABSTRACT

Disclosed is an adjustable height box spring having a first upper bed frame, a first lower bed frame, and plurality of attachment units. The attachment units include a first rod and a second rod, collectively used to detachably attach the first lower bed frame with the first upper bed frame. The adjustable height box spring further includes a second upper bed frame pivotally connected to the first upper bed frame, and a second lower bed frame detachably attached to the second upper bed frame. The adjustable height box spring further includes a third lower bed frame pivotally connected to the first lower bed frame, and a third upper bed frame detachably attached to the third lower bed frame. The pivot attachment allows the second upper bed frame rests on top of the first upper bed frame, and the third upper bed frame rests on bottom of the first lower bed frame, when folded.

17 Claims, 8 Drawing Sheets

(56) References Cited

U.S. PATENT DOCUMENTS 7,376,989 B2 * 5/2008 Wickstrom ..... A47C 27/001 5/250
7,406,727 B2 * 8/2008 Wickstrom ..... A47C 23/005 5/174
7,503,086 B2 * 3/2009 Wickstrom ..... A47C 23/005 5/174
8,312,576 B1 * 11/2012 Oh ..... A47C 23/005 5/177
8,370,973 B1 * 2/2013 Oh ..... A47C 19/122 5/177
8,407,834 B1 * 4/2013 Oh ..... A47C 23/005 5/177
8,769,740 B2 * 7/2014 Oh ..... A47C 19/12 5/177
8,898,832 B2 * 12/2014 Oh ..... A47C 19/12 5/177
9,226,590 B1 * 1/2016 Hull ..... A47C 23/005
9,814,322 B2 * 11/2017 Hull ..... A47C 23/005
9,907,405 B2 * 3/2018 An ..... A47C 19/12
10,034,551 B2 * 7/2018 Hull ..... F16B 12/56
10,362,881 B2 * 7/2019 An ..... A47C 19/122
11,737,575 B2 * 8/2023 Cranney ..... A47C 23/005 5/250
2005/0120478 A1 * 6/2005 Hofmann ..... A47C 19/021 5/200.1
2005/0251911 A1 * 11/2005 Wickstrom ..... A47C 23/005 5/310
2005/0251912 A1 * 11/2005 Wickstrom ..... A47C 23/005 5/249
2006/0123541 A1 * 6/2006 Wickstrom ..... A47C 27/001 5/249
2006/0230532 A1 * 10/2006 Wickstrom ..... A47C 27/001 5/250
2007/0039099 A1 * 2/2007 Kozlowski ..... A47C 19/045 5/236.1
2009/0293193 A1 * 12/2009 Neatherry ..... A47C 23/005 5/1
2012/0042449 A1 * 2/2012 Hull ..... A47C 23/005 5/246
2013/0067659 A1 * 3/2013 Oh ..... A47C 19/12 5/400
2013/0067862 A1 * 3/2013 Oh ..... A47C 23/005 53/429
2014/0283299 A1 * 9/2014 Oh ..... A47C 19/12 5/400
2016/0081484 A1 * 3/2016 Hull ..... F16B 12/56 5/202
2016/0143447 A1 * 5/2016 Hull ..... A47C 23/005 5/202
2017/0119166 A1 * 5/2017 An ..... A47C 17/40
2018/0140104 A1 * 5/2018 An ..... A47C 19/122
2022/0395106 A1 * 12/2022 Cranney ..... A47C 23/005

FOREIGN PATENT DOCUMENTS

WO WO-2016048451 A1 * 3/2016 ..... A47C 23/005
WO WO-2017131836 A1 * 8/2017 ..... A47C 23/005
WO WO-2022261114 A1 * 12/2022 ..... A47C 23/005

* cited by examiner

FOLDABLE BED BOX SPRING

BACKGROUND OF THE INVENTION

1. Field of the Invention

The present invention generally relates to a foldable bed box spring, and more particularly relates to a foldable bed box spring having adjustable height.

2. Description of Related Art

Many household goods are required to have multiple and adjustable functions to meet the demands of modern life. Among them are metal foldable bed frames to accommodate limited living spaces. Conventional bedding products, for example bases, fixed foundations, adjustable foundations and mattresses, are purchased on site at a store.

The bedding products need to be delivered to the purchaser's home, and certain bedding products require some in-home assembly or set-up. The size and weight of conventional bedding products, however, make transportation, assembly and set-up of bedding products difficult for the purchaser. This difficulty increases with the size and weight of the bedding products, for example, the increased weight associated with king size beds and adjustable foundations.

One conventional metal foldable bed frame includes a top frame made of two sub-frames. The bed frame also includes supporting legs pivotally connected to the top frame, and a middle leg disposed between and pivotally connected to the two sub-frames. Usually, the middle leg is connected to middle portions of longitudinal bars of the top frame.

When folded, the middle leg extends beyond the top frame, resulting in the folded bed frame with a dimension (e.g., height or thickness) roughly equal to the sum of the dimensions of the folded top frame and the middle leg. The size of the bed frame when folded is thus not minimized, and consequently, it is impossible to maximize the shipping capacity (e.g., container package density) and difficult to reduce shipping cost.

Therefore, it is necessary to reduce the size of the bed frame for shipping. Further, most of the bed box comes up with a fixed height between 2 inches to 10 inches. Users have to buy different sizes of bed box in order to utilize various heights of the bed. Therefore, there is a need of a foldable bed box spring that allows a user to adjust the height of the bed as per the requirement. Further, the foldable bed box spring should be able to be assembled, disassembled, and shipped at ease.

SUMMARY OF THE INVENTION

In accordance with teachings of the present invention, an adjustable height foldable box spring is provided.

An object of the present invention is to provide an adjustable height box spring with a first upper bed frame, a first lower bed frame and plurality of attachment units. The first upper bed frame includes a first upper rectangular frame, and plurality of first upper indents configured on sides and corners of the first upper rectangular frame. The first lower bed frame includes a first lower rectangular frame and a plurality of first lower indents configured on sides and corners of the first lower bed frame.

Plurality of attachment units are configured to detachably attach the first upper bed frame with the first lower bed frame. Each attachment unit includes a first rod and a second rod. The first rod includes a first open top, and a first cylindrical rod is extending from the first open top, and a first threaded screw is attached to bottom of the first cylindrical rod. The second rod includes a second open top, a second cylindrical rod is extending from the second open top, and a second threaded screw is attached to bottom of the second cylindrical rod. The first open top is configured to align with the first upper indent. The first threaded screw detachably locks at one of the first lower indent. The second rod is configured to detachably lock at either at the first open top or at least one of the first lower indent.

Another object of the present invention is to provide the adjustable height box spring with a second upper bed frame pivotally connected to the first upper bed frame, a second lower bed frame connected to the second upper bed frame via the plurality of attachment units, and plurality of hinges configured to pivotally connect the second upper bed frame with the first upper bed frame. The pivotally attached second upper rectangular frame and the second lower bed frame rests on top of the first upper rectangular frame when folded.

Another object of the present invention is to provide the adjustable height box spring with a third upper bed frame, a third lower bed frame is pivotally connected to the first lower rectangular frame via the hinges, and the plurality of attachment units detachably attaches the third upper bed frame with the third lower bed frame. The third upper bed frame and the third lower bed frame rests on bottom of the first lower rectangular frame.

Another object of the present invention is to provide a plurality of screws. Each screw locks either the first open top with the first upper bed frame or for locking the second open top with the second upper bed frame or for locking the third open top with the third upper bed frame.

Another object of the present invention is to provide each first rod and each second rod with a height which is 3 inches. Further, the height of the first upper frame and the first lower frame is 1 inch.

Another object of the present invention is to provide an adjustable height box spring with a first upper bed frame pivotally connected to a second upper bed frame, a first lower bed frame pivotally connected to a second lower bed frame, and plurality of attachment units to detachably attach the first upper bed frame with the first lower upper bed frame, and to detachably attach the second lower bed frame with the second upper bed frame.

Another object of the present invention is to provide a third upper bed frame pivotally connected to the first upper bed frame, and a third lower bed frame pivotally connected to the first lower bed frame. The attachment unit detachably connects the third upper bed frame with the third lower bed frame. Further, the adjustable height box provides a third upper bed frame detachably connect to the first upper bed frame, and a third lower bed frame detachably connect to the first lower bed frame. The attachment unit detachably connects the third upper bed frame with the third lower bed frame.

Another object of the present invention is to provide plurality of attachment assembly to attach the first lower frame with the second lower frame, and to attach the first upper frame with the third upper frame.

BRIEF DESCRIPTION OF DRAWINGS

These and other features and advantages will be better and completely understood by referring to the following detailed description of presently preferred example embodiments in accordance with the drawings, of which.

DETAILED DESCRIPTION OF DRAWINGS

Figure 1A:
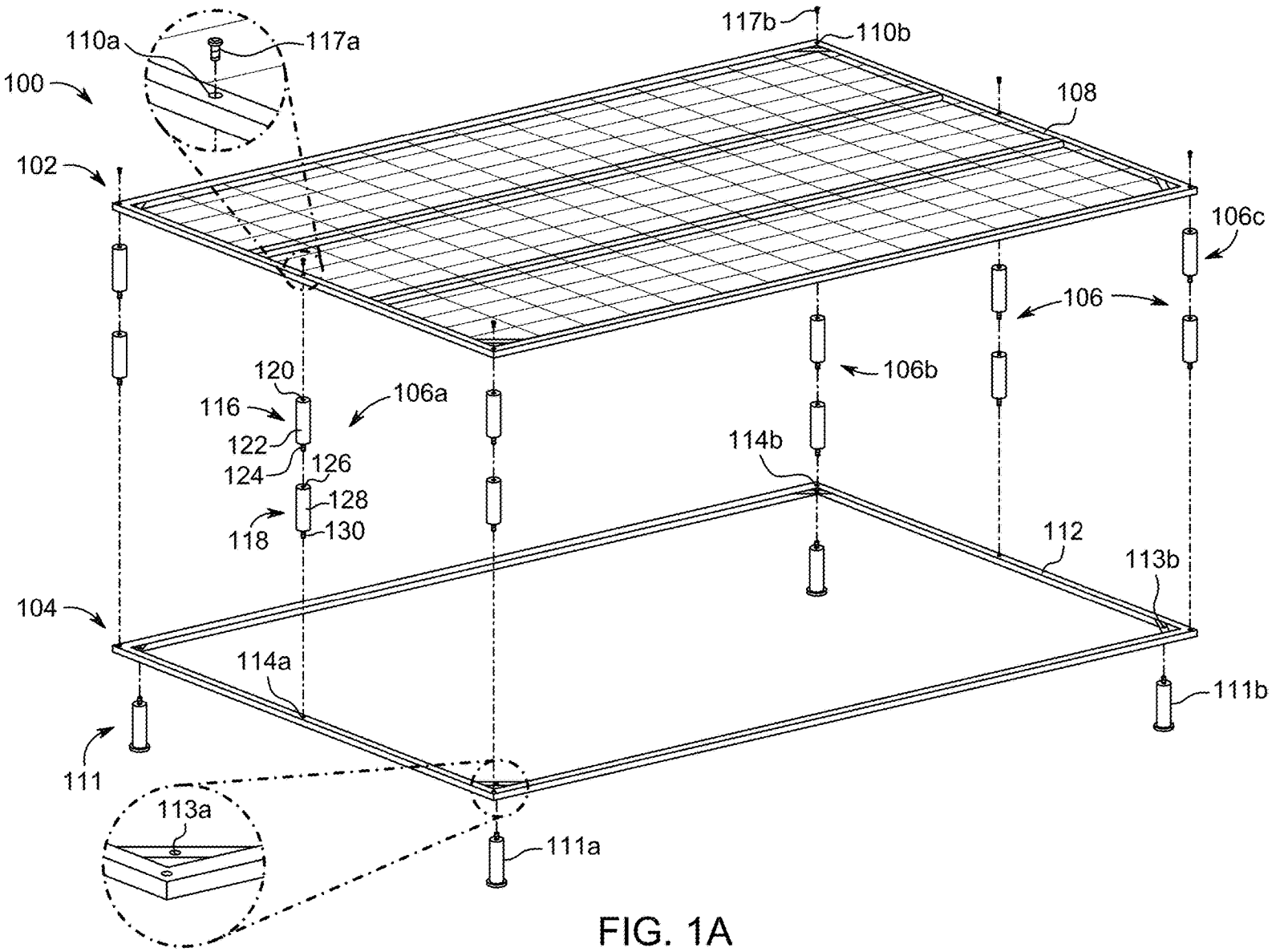
FIG. 1A illustrates an exploded view of an adjustable height box spring in accordance with an embodiment of the present invention.

While this technology is illustrated and described in a preferred embodiment, an adjustable height box spring may be produced in many different configurations, forms and materials. There is depicted in the drawings, and will herein be described in detail, as a preferred embodiment of the invention, with the understanding that the present disclosure is to be considered as an exemplification of the principles of the invention and the associated functional specifications for its construction and is not intended to limit the invention to the embodiment illustrated. Those skilled in the art will envision many other possible variations within the scope of the technology described herein.

FIG. 1A illustrates an exploded view of an adjustable height box spring 100 in accordance with an embodiment of the present invention. The adjustable height box spring 100 includes a first upper bed frame 102, a first lower bed frame 104 and a plurality of attachment units 106. The first upper bed frame 102 includes a first upper rectangular frame 108 and plurality of first upper indents 110 such as 110*a*, 110*b* configured on sides and corners of the first upper rectangular frame 108.

The first lower bed frame 104 includes a first lower rectangular frame 112 and a plurality of first lower indents 114 such as 114*a*, 114*b* configured on sides and corners of the first lower bed frame 112. In an embodiment, dimensions of the first upper bed frame 102 and dimensions of the first lower bed frame 104 is between 3 feet×7 feet. The weight of the adjustable height box 100 is approx. 1000 lbs.

The plurality of attachment units 106 such as 106*a*, 106*b*, 106*c* are configured to detachably attach the first upper bed frame 102 with the first lower bed frame 104. Each of the attachment units 106 such as the attachment unit 106*a* includes a first rod 116 and a second rod 118. The first rod 116 includes a first open top 120, a first cylindrical rod 122 extending from the first open top 120, and a first threaded screw 124 is attached to bottom of the first cylindrical rod 122.

The second rod 118 includes a second open top 126, a second cylindrical rod 128 extending from the second open top 126, and a second threaded screw 130 is attached to bottom of the second cylindrical rod 128. The first open top 120 is configured to align with the first upper indent 110*a* and the first threaded screw 124 detachably locks at the first lower indent 114*a*.

The second rod 118 (along with the second threaded screw 130) is configured to detachably locks at either the first open top 120 or at the first lower indent 114*a*. In one embodiment of the present invention, the attachment units 106 assist in adjusting the height of the first upper bed frame 102 from the first lower bed frame 112, and ultimately resulting adjusting the height of the first upper bed frame 102 from floor.

The plurality of attachment units 106 further includes a plurality of screws 117 such as 117*a*, 117*b*. The screw 117*a* is to lock the first open top 120 with the first upper bed frame 102. Examples of the screws 117 include but not limited to a M8*35 screw and M6*55 screw, etc. It would be readily apparent to those skilled in the art the various number of attachment units 106 and screws 117 may be envisioned without deviating from the scope of the present invention.

In one embodiment, the adjustable height box spring 100 includes plurality of support legs 111 such as 111*a*, 111*b* to detachably attach with the first lower frame 104 at indents 113*a*, 113*b*. The support legs 111 increases the height of the adjustable height box spring 100 from ground. It would be readily apparent to those skilled in the art that many types and number of support legs 111 may be envisioned without deviating from the scope of the present invention.

Figure 1B:
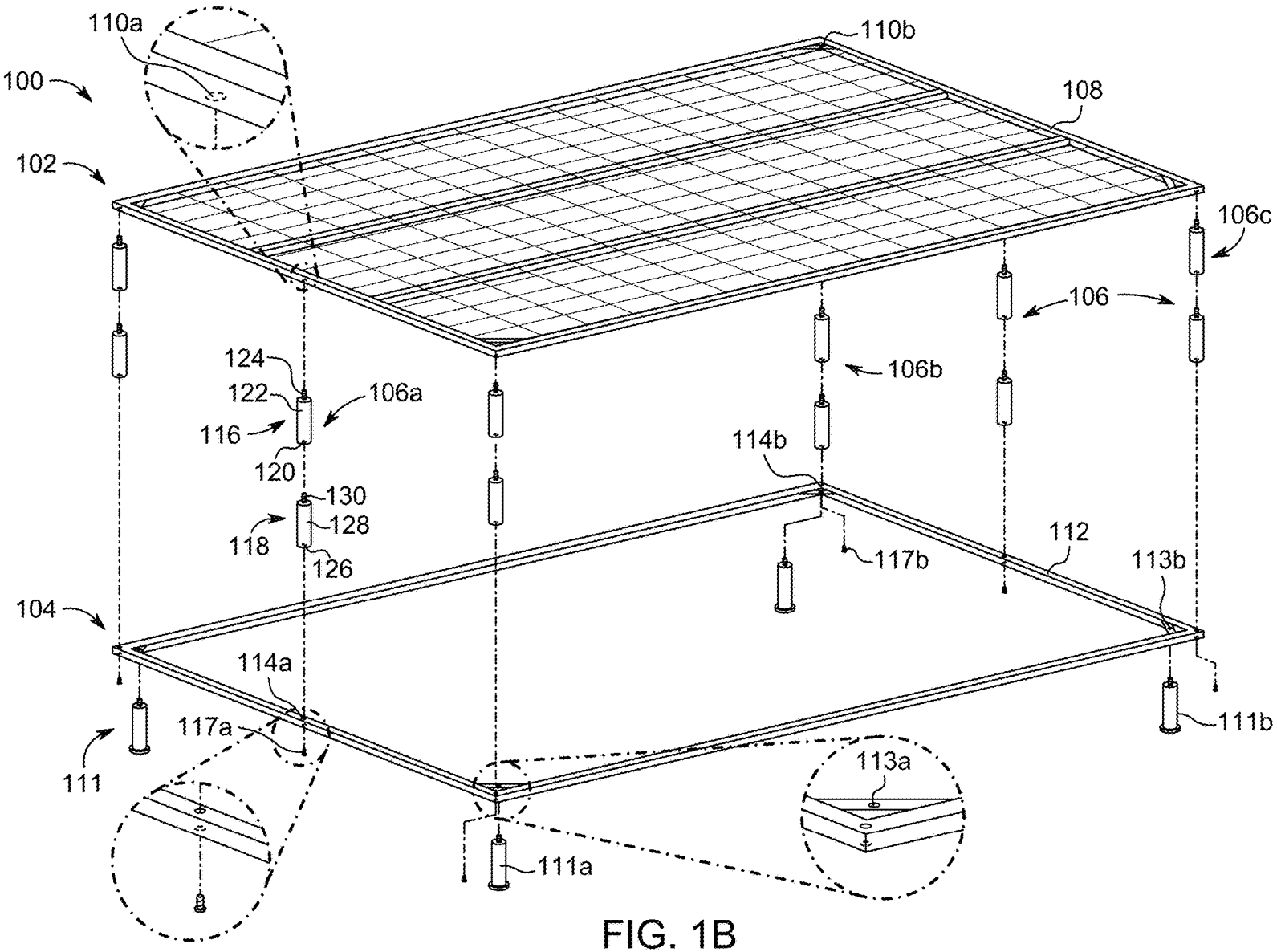
FIG. 1B illustrates an exploded view of an adjustable height box spring in accordance with another embodiment of the present invention.

FIG. 1B illustrates an exploded view of an adjustable height box spring 100 in accordance with another embodiment of the present invention. The screw 117*a* passes through the first lower indent 114*a* to lock at the second open top 126. Further, the second threaded screw 130 locks at the first open top 120 and the first threaded screw 124 locks at the first upper indent 110*a*. In an embodiment, the first upper indent 110 is configured on lower surface of the first upper bed frame 102.

Figure 2A:
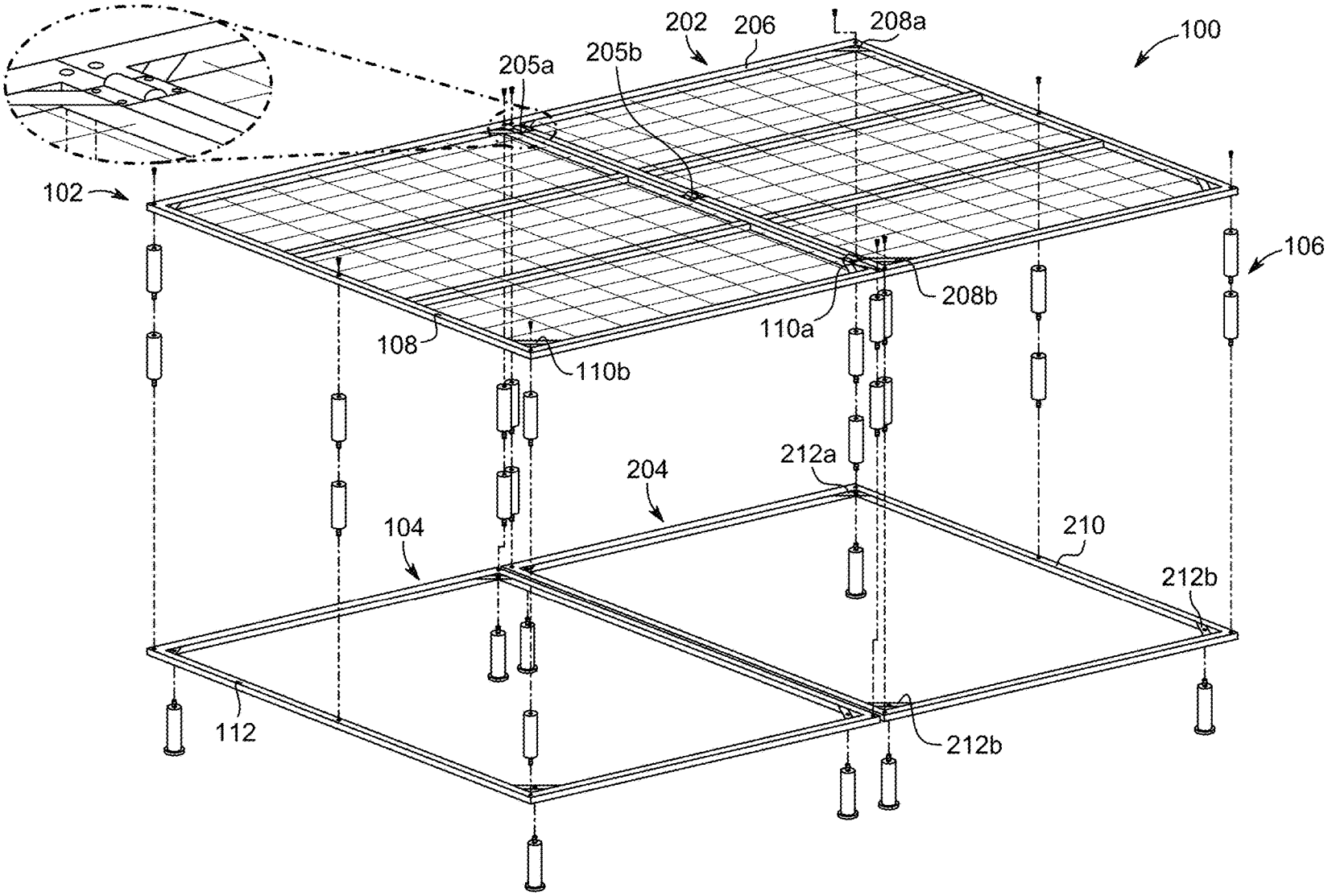
FIG. 2A illustrates an exploded view of the adjustable height box spring in another embodiment of the present invention.

FIG. 2A illustrates an exploded view of the adjustable height box spring 100 in another embodiment of the present invention. The adjustable height box spring 100 further includes a second upper bed frame 202, a second lower bed frame 204, and plurality of hinges 205 such as hinge 205*a*, hinge 205*b*. The second upper bed frame 202 is pivotally connected to the first upper bed frame 102. The second lower bed frame 204 is detachably attached to the second upper bed frame 202 via the plurality of attachment units 106. The plurality of attachment units 106 is explained in detail in conjunction with FIG. 1 of the present invention.

The second upper bed frame 202 includes a second upper rectangular frame 206 and a plurality of second upper indents 208 such as 208*a*, 208*b* are configured on sides and corners of the second upper rectangular frame 206. The second lower bed frame 204 includes a second lower rectangular frame 210, and a plurality of second lower indents 212 such as 212*a*, 212*b* are configured on sides and corner of the second lower rectangular frame 210.

The plurality of hinges 205 such as 205*a*, 205*b* pivotally attaches a longitudinal side of the second upper rectangular frame 206 with a longitudinal side of the first upper rectangular frame 108. In one embodiment, the second lower rectangular frame 210 is detachably attached to the first lower rectangular frame 112 via plurality of attachment assembly (402, shown in FIG. 4). In an embodiment, dimensions of the first upper bed frame 102 and the second upper bed frame 202 is between 3 feet×7 feet, and the dimensions of the first lower bed frame 104 and the second lower bed frame is between 3 feet×7 feet.

Figure 2B:
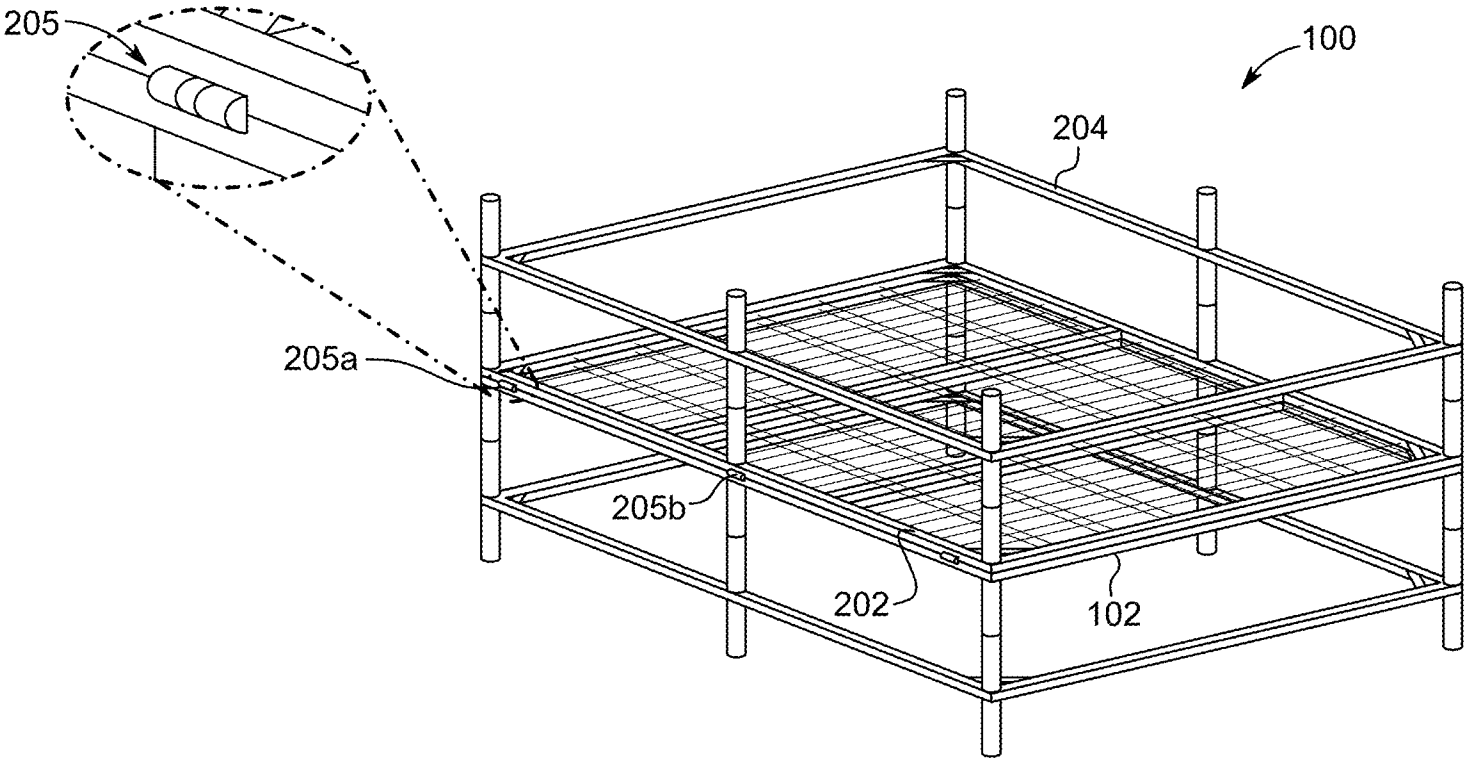
FIG. 2B illustrates a perspective view of the adjustable height box spring in accordance with an embodiment of the present invention.

FIG. 2B illustrates a perspective view of the adjustable height box spring 100 in accordance with an embodiment of the present invention. The second upper bed frame 202 and the second lower bed frame 204 rests on top of the first upper bed frame 102 when folded. The second upper bed frame 202 is folded on top of the first upper bed frame 102 via the hinges 205*a*, 205*b*. It would be readily apparent to those skilled in the art that multiple number of hinges 205 may be envisioned without deviating from the scope of the present invention.

Figure 3A:
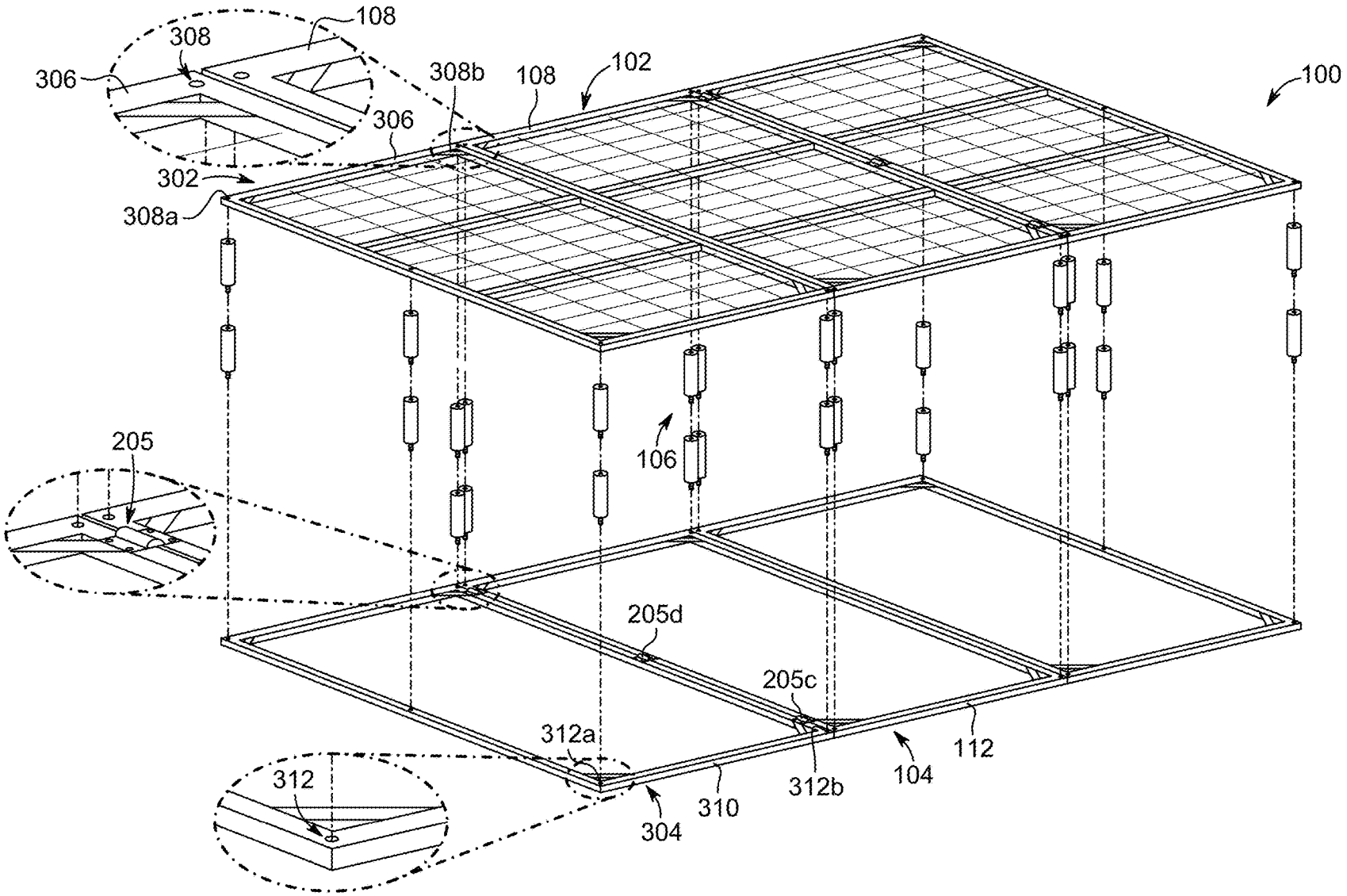
FIG. 3A illustrates an exploded view of the adjustable height box spring in accordance with another embodiment of the present invention.

FIG. 3A illustrates an exploded view of the adjustable height box spring 100 in accordance with another embodiment of the present invention. The adjustable height box spring 100 includes a third upper bed frame 302, a third lower bed frame 304 pivotally connected to the first lower bed frame 104. The third upper bed frame 302 includes a third upper rectangular frame 306, and a plurality of third upper indents 308 such as 308*a*, 308*b* configured on sides and corners of the third upper rectangular frame 306.

The third lower bed frame 304 includes a third lower rectangular frame 310, and a plurality of third lower indents 312 such as 312*a*, 312*b* configured on the third lower rectangular frame 310. The plurality of hinges 205*c*, 205*d* are configured to pivotally attach a longitudinal side of the third lower rectangular frame 310 with another longitudinal side of the first lower rectangular frame 112.

Figure 3B:
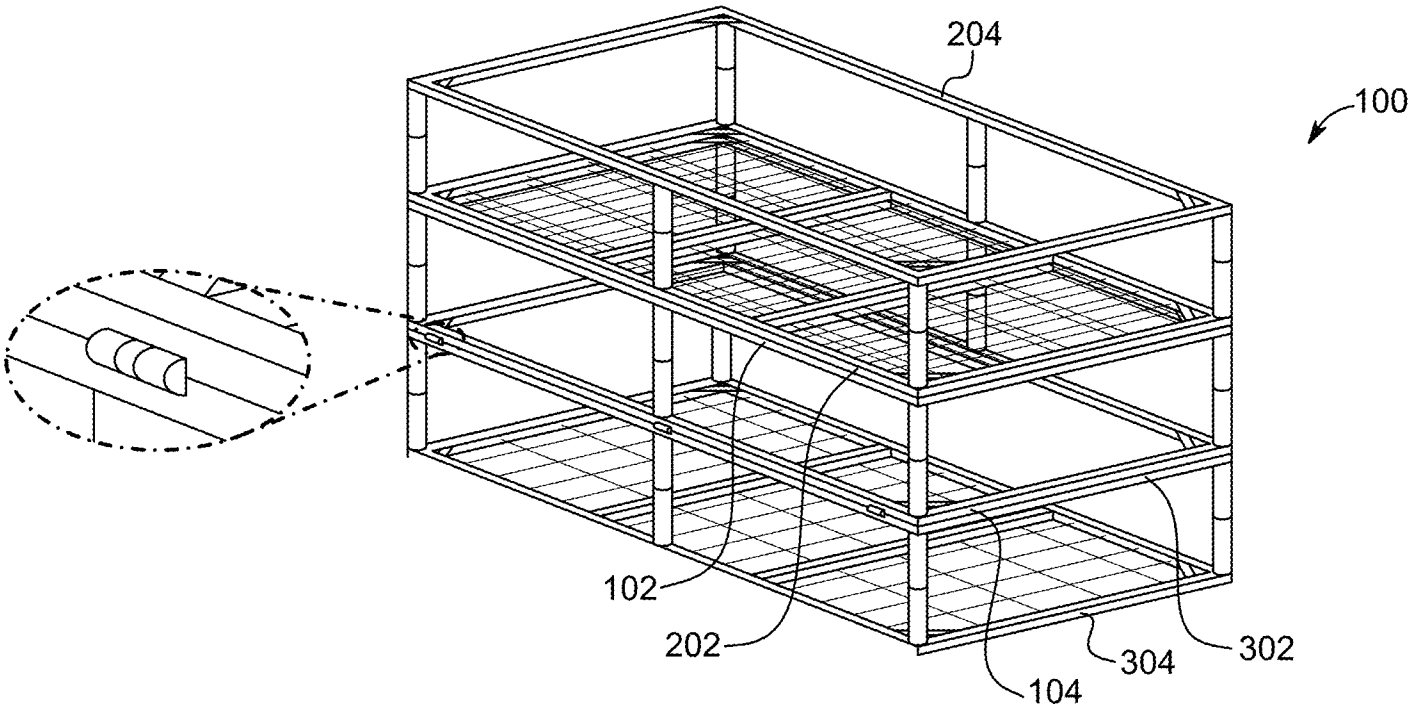
FIG. 3B illustrates a perspective view of adjustable height box spring when folded.

FIG. 3B illustrates a perspective view of adjustable height box spring 100 when folded. The second upper bed frame 202 and the second lower bed frame 204 rests on top of the first upper bed frame 102. The third upper bed frame 302 and the third lower bed frame 304 rests on the bottom of the first lower bed frame 104, when folded. In an embodiment, dimensions of the first upper bed frame 102, the second upper bed frame 202 and the third upper bed frame 302 is between 3 feet×7 feet, and the dimensions of the first lower bed frame 104, the second lower bed frame 204 and the third lower bed frame 304 is between 3 feet×7 feet.

Figure 3C:
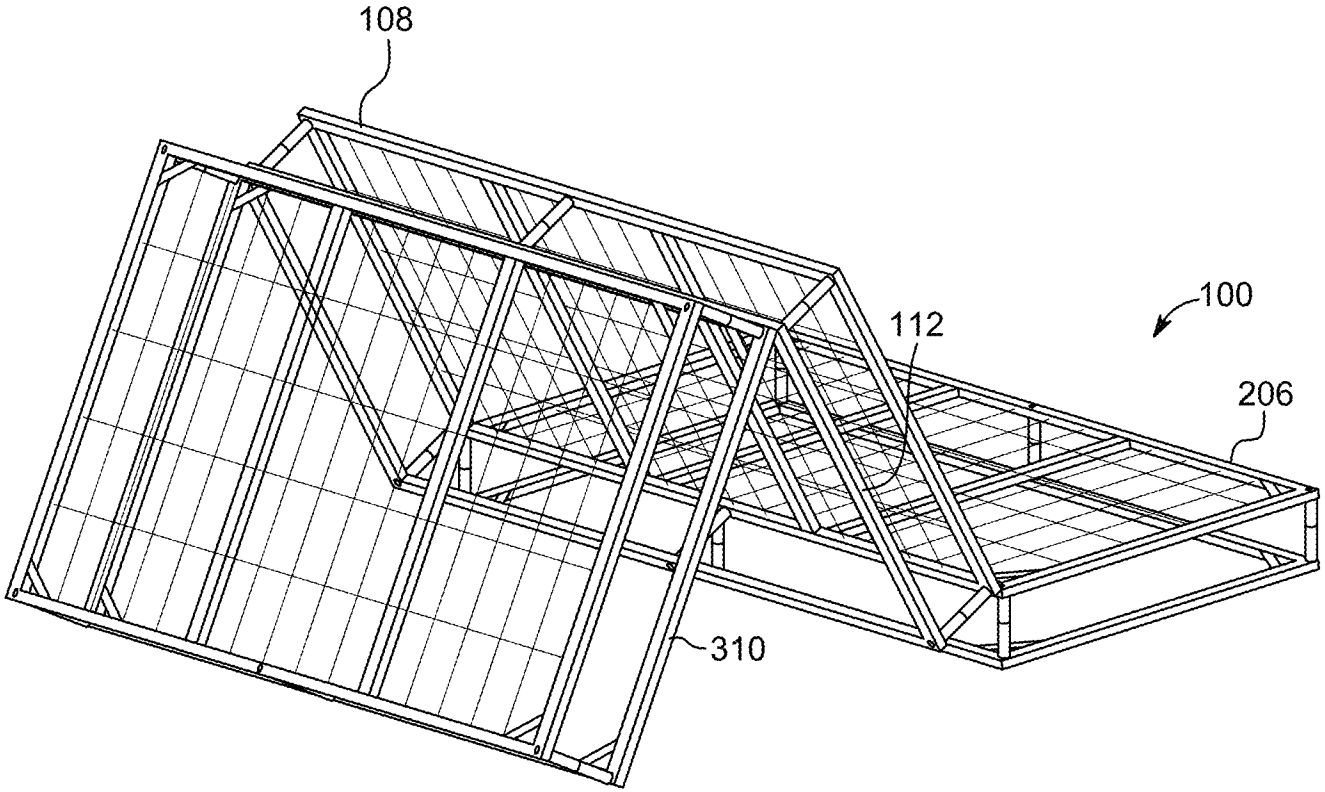
FIG. 3C illustrates a perspective view to showcase folding of the adjustable height box spring in accordance with an embodiment of the present invention.

FIG. 3C illustrates a perspective view to showcase folding of the adjustable height box spring 100 in accordance with an embodiment of the present invention. The first upper rectangular frame 108 is pivotally connected to the second upper rectangular frame 206. The first lower rectangular frame 112 is pivotally connected to the third lower rectangular frame 310. The hinges (205, not shown in FIG. 3C) are used to pivotally connect the first upper rectangular frame 108 with the second upper rectangular frame 206, and to pivotally connect the first lower rectangular frame 112 with the third lower rectangular frame 310.

Figure 4:
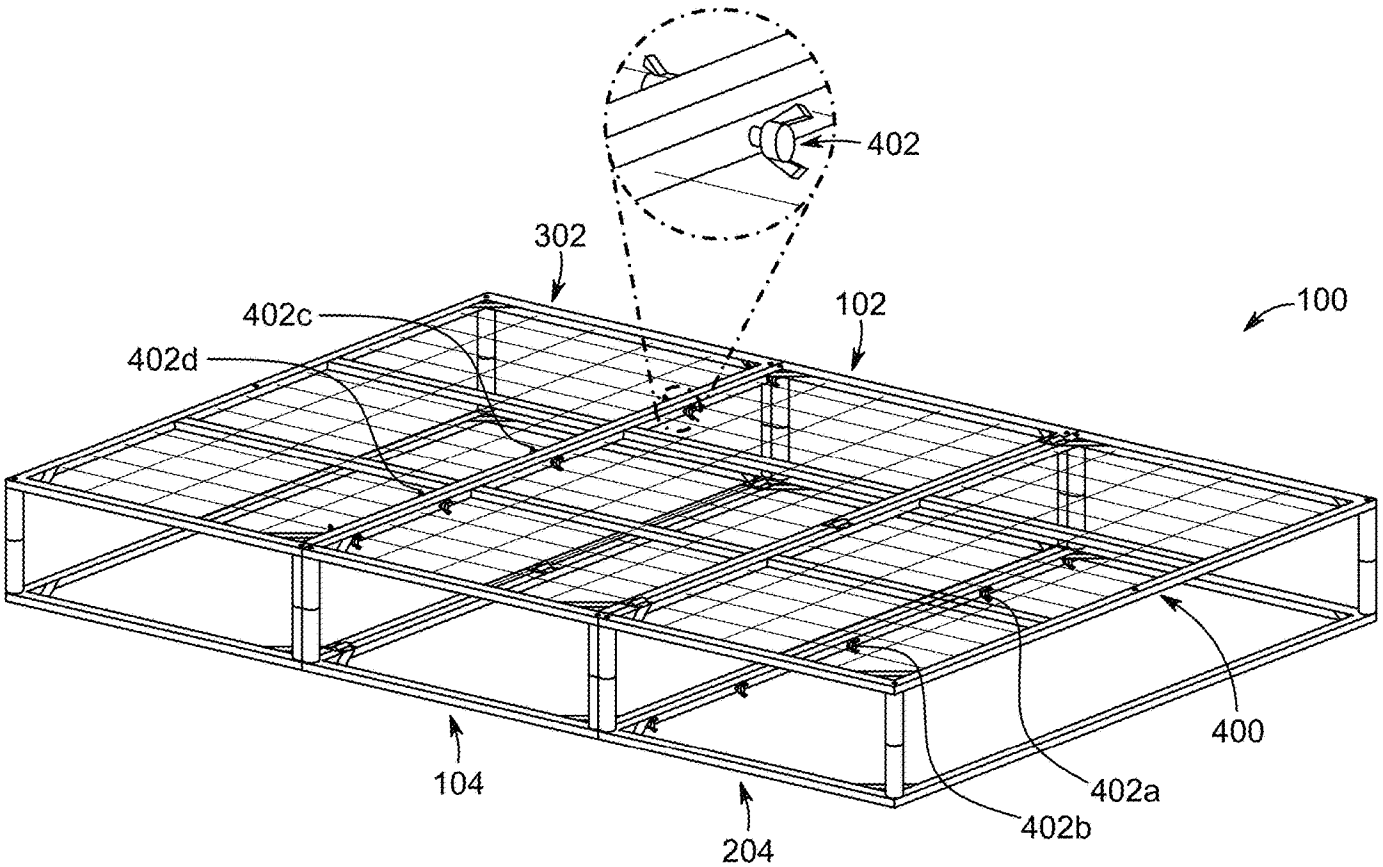
FIG. 4 illustrates a perspective view of the adjustable height box spring in accordance with an embodiment of the present invention.

FIG. 4 illustrates a perspective view of the adjustable height box spring 100 in accordance with an embodiment of the present invention. The adjustable height box spring 100 further includes a plurality of attachment assemblies 402 such as 402*a*, 402*b*, 402*c*, 402*d* etc. In one embodiment, the attachment assembly 402*a*, 402*b* is used to detachably attach the first lower bed frame 104 with the second lower bed frame 204. Similarly, the attachment assembly 402*c*, 402*d* is used to detachably attach the first upper bed frame 102 with the third upper rectangular frame 302.

In an embodiment, the attachment assembly 402 is a butterfly nut. However, it would be readily apparent to those skilled in the art that various type and number of attachment assembly 402 may be envisioned to attach the bed frames with each other without deviating from the scope of the present invention.

It would be readily apparent to those skilled in the art that the screw 117*a* may be used to attach the second rod 118 to the first lower bed frame 104 without deviating from the scope of the present invention. Further, it would be readily apparent to those skilled in the art the screws may be used to attach second rod to second lower bed frame and the third lower bed frame without deviating from the scope of the present invention.

The present invention offers various advantages such as providing an adjustable height box spring to allow a user to adjust height of the box spring to 2 inches, 5 inches and 8 inches. Further, the present invention offers various advantages such as allowing easy detachment and attachment of the frames to ease burden of shipping.

Embodiments of this invention are described herein. Variations of those embodiments may become apparent to those having ordinary skill in the art upon reading the foregoing description. The inventors expect that skilled artisans will employ such variations as appropriate, and the inventors intend for the invention to be practiced other than as specifically described herein. Accordingly, this invention includes all modifications and equivalents of the subject matter recited in the claims appended hereto as permitted by applicable law. Moreover, any combination of the above-described elements in all possible variations hereof is encompassed by the invention unless otherwise indicated herein or otherwise clearly contradicted by context.

While the disclosure above sets forth the principles of the present invention, with the examples given for illustration only, one should realize that the use of the present invention includes all usual variations, adaptations and/or modifications within the scope of the claims attached as well as equivalents thereof.

The use of the terms "a" and "an" and "the" and similar referents in the context of describing an invention (especially in the context of the following claims) are to be construed to cover both the singular and the plural, unless otherwise indicated herein or clearly contradicted by context. The terms "comprising," "having," "including," and "containing" are to be construed as open-ended terms (i.e., "including, but not limited to,") unless otherwise noted.

Those skilled in the art will appreciate from the foregoing that various adaptations and modifications of the just described embodiments can be configured without departing from the scope and spirit of the invention. Therefore, it is to be understood that, within the scope of the appended claims, the invention may be practiced other than as specifically described herein.

The invention claimed is:

1. An adjustable height box spring comprising:

a first upper bed frame comprising:
- a first upper rectangular frame; and
- plurality of first upper indents configured on sides and corners of the first upper rectangular frame;

a first lower bed frame comprising:
- a first lower rectangular frame; and
- plurality of first lower indents configured on sides and corners of the first lower bed frame; and plurality of attachment units configured to detachably attach the first upper bed frame with the first lower bed frame, wherein each attachment unit comprising:
- a first rod comprising:
  - a first open top;
  - a first cylindrical rod extending from the first open top; and
  - a first threaded screw attached to a bottom of the first cylindrical rod; and
- a second rod comprising:
  - a second open top;

a second cylindrical rod extending from the second open top; and a second threaded screw attached to a bottom of the second cylindrical rod;

wherein the first open top is configured to align with one of the first upper indents; the first threaded screw detachably locks at one of the first lower indents; and wherein the second rod is configured to detachably at least one of: the first open top; and at least one of the first lower indents.

2. The adjustable height box spring according to claim 1 further comprising:

a second upper bed frame pivotally connected to the first upper bed frame comprising:

a second upper rectangular frame; and plurality of second upper indents configured on sides and corners of the second upper rectangular frame;

a second lower bed frame detachably attached to the second upper bed frame via the plurality of attachment units, the second lower bed frame comprising:

a second lower rectangular frame; and plurality of second lower indents configured on sides and corners of the second lower rectangular frame; and plurality of hinges configured to pivotally attach a longitudinal side of the second upper rectangular frame with a longitudinal side of the first upper rectangular frame, wherein the second upper bed frame and the second lower bed frame rests on top of the first upper bed frame when folded.

3. The adjustable height box spring according to claim 2, further comprising:

a third upper bed frame comprising:

a third upper rectangular frame; and plurality of third upper indents configured on sides and corners of the third upper rectangular frame; and a third lower bed frame pivotally connected to the first lower bed frame comprising:

a third lower rectangular frame; and plurality of third lower indents configured on the third lower rectangular frame;

wherein the plurality of hinges configured to pivotally attach a longitudinal side of the third lower rectangular frame with another longitudinal side of the first lower rectangular frame, wherein the pivotally attached third upper rectangular frame rests on the bottom of the first lower rectangular frame when folded.

4. The plurality of attachment units according to claim 3 further comprising a plurality of screws, wherein at least one screw locks the first open top of the first rod with the first upper bed frame.

5. The adjustable height box spring according to claim 4 wherein at least one screw of the plurality of screws locks the attachment units with the second upper bed frame.

6. The adjustable height box spring according to claim 4 wherein at least one screw of the plurality of screws locks the attachment units with the third upper bed frame.

7. The adjustable height box spring according to claim 1, wherein the height of the first upper bed frame is 1 inch and the height of the first lower bed frame is 1 inch.

8. The adjustable height box spring according to claim 1, wherein the height of each second rod and each first rod is 3 inches.

9. The adjustable height box spring according to claim 3 further comprising plurality of attachment assemblies to attach the first lower bed frame with the second lower bed frame, and to attach the first upper bed frame with the third upper bed frame.

10. An adjustable height box spring comprising:

a first upper bed frame comprising:

a first upper rectangular frame; and plurality of first upper indents configured on sides and corners of the first upper rectangular frame;

a second upper bed frame pivotally connected to the first upper bed frame, the second upper bed frame comprising:

a second upper rectangular frame; and plurality of second upper indents configured on sides and corners of the second upper rectangular frame;

a first lower bed frame comprising:

a first lower rectangular frame; and plurality of first lower upper indents configured on sides and corners of the first lower rectangular frame;

a second lower bed frame configured to detachably attach with the first lower bed frame comprising: a second lower rectangular frame; and plurality of second lower indents configured on sides and corners of the second lower rectangular frame;

a third lower bed frame pivotally connected to the first lower bed frame, the third lower bed frame comprising:

a third lower rectangular frame; and plurality of third lower indents configured on sides and corners of the third lower rectangular frame;

plurality of hinges configured to attach a longitudinal side of the first upper bed frame with a longitudinal side of the second upper bed frame, wherein the pivotally attached first upper bed frame rests on top of the second upper bed frame when folded, wherein the plurality of hinges configured to attach a longitudinal side of the first lower bed frame with a longitudinal side of the third lower bed frame, wherein the pivotally attached first lower bed frame rests on top of the third lower bed frame when folded; and plurality of attachment units configured to detachably attach the first upper bed frame with the first lower bed frame, and the second upper bed frame with the second lower bed frame, wherein each attachment unit comprising: at least one of a first rod; and a second rod;

wherein the first rod comprising:

a first open top;

a first cylindrical rod extending from the first open top; and a first threaded screw attached to a bottom of the first cylindrical rod;

wherein the second rod comprising:

a second open top;

a second cylindrical rod extending from the second open top; and a second threaded screw attached to a bottom of the second cylindrical rod;

wherein the first open top is configured to align with one of the first upper indents and the first threaded screw detachably locks at one of the first lower indents; and wherein the second rod is configured to detachably lock at least one of: the first open top; and at least one of the first lower indents, further at least one of the attachment units is configured to detachably attach the second upper bed frame with the first upper bed frame.

11. The adjustable height box spring according to claim 10 further comprising:

a third upper bed frame configured to detachably attach with the second upper bed frame, the third upper bed frame comprising:

a third upper rectangular frame; and plurality of third upper indents configured on sides and corners of the third upper rectangular frame;

plurality of attachment assemblies configured to detachably attach a longitudinal side of the third upper rectangular frame with another longitudinal side of the second upper rectangular frame, and further the plurality of attachment assemblies configured to detachably attach a longitudinal side of the second lower rectangular frame with another longitudinal side of the first lower rectangular frame.

12. The adjustable height box spring according to claim 11 further comprising:

the third lower bed frame configured to pivotally connect with another longitudinal side of the second lower bed frame, the third lower bed frame comprising:

a third lower rectangular frame; and plurality of third lower indents configured on sides and corners of the third lower rectangular frame;

wherein the plurality of hinges are configured to pivotally connect a longitudinal side of the third upper bed frame with another longitudinal side of the second upper bed frame, and the plurality of hinges are configured to pivotally connect a longitudinal side of the third lower bed frame with another longitudinal side of the second lower bed frame.

13. The plurality of attachment units according to claim 10 further comprising a plurality of screws, wherein at least one screw locks first open top with the first upper bed frame.

14. The adjustable height box spring according to claim 13 wherein at least one screw of the plurality of screws locks the attachment units with the second upper bed frame.

15. The adjustable height box spring according to claim 11 wherein at least one screw of the plurality of screws locks the attachment units unit with the third upper bed frame.

16. The adjustable height box spring according to claim 10, wherein the height of the first upper bed frame is 1 inch and the height of the first lower bed frame is 1 inch.

17. The adjustable height box spring according to claim 10, wherein the height of each second rod and each first rod is 3 inches.

* * * * *